United States Patent [19]

Murata

[11] Patent Number: 4,981,381

[45] Date of Patent: Jan. 1, 1991

[54] PLATEN ROLLER WITH COMPOSITION GIVING INCREASED DURABILITY

[75] Inventor: Jun Murata, Saitama, Japan

[73] Assignee: Canon Kabushiki Kaisha, Tokyo, Japan

[21] Appl. No.: 414,597

[22] Filed: Sep. 29, 1989

Related U.S. Application Data

[63] Continuation of Ser. No. 159,307, Feb. 22, 1988, abandoned.

[30] Foreign Application Priority Data

| | | | |
|---|---|---|---|
| Feb. 23, 1987 | [JP] | Japan | 62-037734 |
| Feb. 23, 1987 | [JP] | Japan | 62-037735 |
| Nov. 30, 1987 | [JP] | Japan | 62-299695 |

[51] Int. Cl.[5] ..... B41J 11/04; B41J 11/053

[52] U.S. Cl. ..... 400/661; 400/662; 29/132

[58] Field of Search ..... 400/659, 661, 661.1, 400/662

[56] References Cited

U.S. PATENT DOCUMENTS

| | | | |
|---|---|---|---|
| 1,963,856 | 6/1934 | Lewis et al. | 400/661.1 |
| 2,053,107 | 9/1936 | Pitman | 400/661.1 |
| 2,588,993 | 3/1952 | Schroeder | 400/662 |

FOREIGN PATENT DOCUMENTS

| | | | |
|---|---|---|---|
| 0249419 | 12/1987 | European Pat. Off. | 400/661.1 |
| 52373 | 3/1985 | Japan | 400/661 |
| 161441 | 8/1985 | Japan . | |
| 0162672 | 8/1985 | Japan | 400/662 |
| 2809960 | 12/1986 | Japan | 400/661.1 |
| 10147 | 3/1987 | Japan . | |
| 138264 | 6/1987 | Japan | 400/661.1 |

*Primary Examiner*—Clifford D. Crowder

*Attorney, Agent, or Firm*—Fitzpatrick Cella, Harper & Scinto

[57] ABSTRACT

A platen roller includes a core member and a rubber member which covers the circumferential surface of the core member. The rubber member is arranged to have a hardness value of 95±3, JIS A, at 20° to 25° C. on the basis of JIS K6301-5.2 and a rebound resilience value of 4 to 7% at 20° to 30° on the basis of JIS K6301-11.

8 Claims, 3 Drawing Sheets

PLATEN ROLLER WITH COMPOSITION GIVING INCREASED DURABILITY

This application is a continuation of application Ser. No. 159,307 filed Feb. 22, 1988, now abandoned.

BACKGROUND OF THE INVENTION

1. Field of the Invention

This invention relates to a platen roller and more particularly to a platen roller adapted for a printer of a typewriter or the like.

2. Description of the Related Art

The printers of typewriters or the like are provided with platen rollers which serve as substrate plates for printing. Generally, the platen roller is manufactured in a cylindrical shape with a rubber member 2 arranged to encompass a core member 1 as shown in FIG. 2 of the accompanying drawings. In printing, for example, a printing paper 3 is brought into tight contact with the circumferential surface of the rubber member 2, as shown in FIG. 3. Then, a print element which is typically represented by a daisy wheel 5 is pushed against the rubber member 2 by hitting the wheel 5 with a print hammer 6 at a part where an ink ribbon 4 is superimposed on the printing paper 3, so that a desired character of the print element can be printed on the printing paper 3.

The printing performance on the printing paper depends on the hammering energy of the printer and the hardness of the rubber member which forms the platen roller. With the hammer energy assumed to be unvarying, the printing performance becomes better accordingly as the hardness of the rubber member increases. Therefore, if the hardness of the rubber member is inadequate for the hammer energy of the used printer, the quality of the print would degrade due to such a defect that a part of the printed character is missing or the contour of the character is obscure.

To avoid such inadequate printing, efforts have heretofore been exerted to find a way as to how to increase the hardness of the rubber member for the platen roller. The methods generally employed for attaining a higher degree of hardness have been, for example, as follows: In one method, the rubber composition is arranged to include at least 20 phr of an organic reinforcer such as a modified melamine resin, a high styrene resin or a phenol resin, for 100 of a polymer. In another method, fillers which are to be contained in the rubber (normally carbon black, an inorganic filler such as a white filler, etc.) are arranged to include, at least 50% by weight, the carbon black of a fine grain size which is at the level of FEF carbon or finer than that.

A vulcanized rubber material which is thus obtained has a desired degree of hardness. However, the rubber material thus obtained generally has an excessively high rebound resilience. Therefore, a platen roller made of such a rubber material causes a great hammer rebound. In other words, only small portion of the whole hammer energy of the printer is consumed for actual printing. In short, it degrades the hammer energy efficiency. It has been thus necessary to make up for the inefficiency by increasing the hammer energy for adequate printing. This causes an increase in the impact load. The wear of the print element thus has been accelerated to result in worn-out types.

To cope with the above stated problem, efforts have been exerted to increase the durability of the print element. For example, in cases where a daisy wheel is employed as the print element, the daisy wheel has been prepared by a so-called dichroic molding process using an expensive phenol resin material for the type part which is apt to wear away and an abrasion resisting material such as polyamide for a part carrying the daisy wheel. However, the problem has not been completely solved as there is a limit to the improvement in the durability. Besides, the conventional solution has presented another problem in terms of economy.

SUMMARY OF THE INVENTION

It is an object of this invention to provide a platen roller which has low impact resilience and good printing performance thus ensuring excellent durability of types.

It is another object of the invention to provide a platen roller which excels in sound and vibration preventing effects.

A platen roller embodying this invention is provided with a rubber member which is disposed round a core member. The rubber member has a hardness value of 95±3, JIS type A, at 20 to 25° C. (JIS K6301-5.2) and a rebound resilience value of 4 to 7% at 20 to 30° C. (JIS K6301-11). While this value of hardness is about the same as that of the platen rollers generally in use, the rebound resilience of the rubber member is lower than that of the rubber members of the conventional ordinary platen rollers. This rubber member thus lessens the rebound of the hammer during printing to permit higher efficiency of hammer energy than the conventional platen roller. The use of the invented platen roller, therefore, enables the printer to adequately perform printing with less amount of hammer energy than the conventional device. Further, the impact load which is imposed at the time of hammer pounding can be alleviated to ensure the longer durability of the print element such as a daisy wheel. This improvement in durability then permits without difficulty the use of such a print element that has been considered too inferior in durability in the past, such as a polyamide daisy wheel made by monochroic molding. Further, the invented platen roller permits reduction in the hammer energy, so that the noises and vibrations generated in printing can be lessened. Further, since the rebound resilience value at 20° to 30° C. is reduced to a value between 4 and 7% according to this invention, the temperature dependency of the rebound resilience can be lowered even at ambient temperature ranging from 10° to 40° C. at which a printer such as a typewriter is normally used. Therefore, the hammer energy efficiency is thus enhanced throughout the whole range or the above stated ambient temperature, so that the temperature dependency of printing efficiency also can be lowered in accordance with this invention.

The above and other object and features of the invention will become apparent from the following detailed description of embodiments thereof taken in connection with the accompanying drawings.

DETAILED DESCRIPTION OF THE PREFERRED EMBODIMENTS

Figure 1:
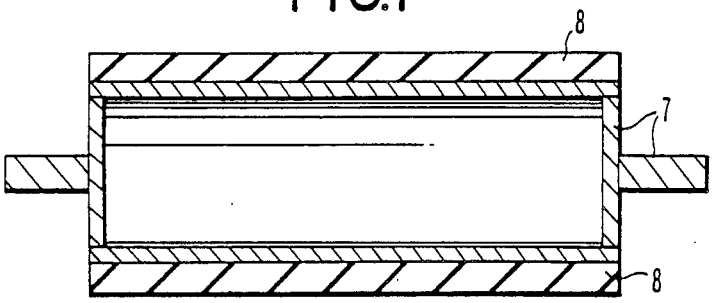
FIG. 1 is a sectional view showing a platen roller as an embodiment of this invention.
Figure 2:
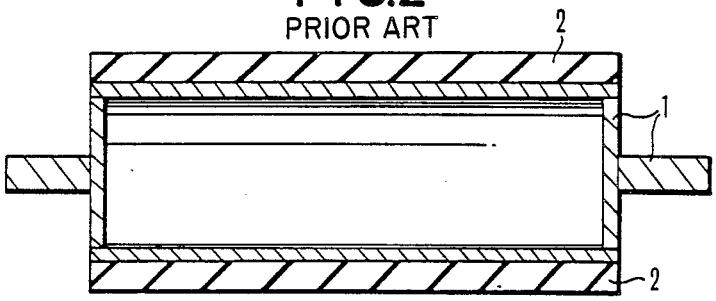
FIG.2 PRIOR ART
FIG. 2 is a sectional view showing an example of the conventional platen roller.

Referring to FIG. 1 which shows a platen roller as a preferred embodiment of this invention, the platen roller is basically formed by applying to the outer circumference of a core member 7 a rubber member 8 which has the hardness and rebound resilience values mentioned in the foregoing. The core member 7 may be made of a metal material such as stainless steel, aluminum, soft steel or the like or a resin material such as phenol, styrene, melamine or urea resin or the like. However, in order to obtain a necessary degree of impact for a good printing performance, the core member 7 is preferably arranged to have adequate rigidity and hardness.

The rubber member 8 must be arranged, as mentioned in the foregoing, to have a hardness value of 95±3, JIS A, at temperature between 20° and 25° C. (JIS K6301-5.2) and a rebound resilience value of 4 to 7% at temperature between 20° and 30° C. (JIS K6301-11). A platen roller arranged to have this degree of hardness adequately meets the durability requirement for application to a printer or a typewriter.

The rubber member having the above stated hardness and rebound resilience is obtainable by suitably adjusting the blending amounts of components that are normally used in blending a rubber material for a platen roller, including: a raw rubber material polymer (such as a natural or synthetic rubber and/or a thermoplastic elastomer), carbon, inorganic filler, oil, sulfur, a vulcanization assistant, a vulcanization accelerator, stearic acid, etc. and, if necessary, some cross linking agent such as a peroxide, a plasticizer or a reinforcer.

For example, the rubber member may be prepared by increasing the concentration of a vulcanizing agent such as sulfur, preferably by adding at least 15 parts by weight of the vulcanizing agent to 100 parts by weight of the raw rubber material polymer; and by arranging the inorganic filler to contain less than 50% by weight of carbon black which is preferably of a finer grain size than FEF.

The raw rubber material polymer may be selected from a group consisting of rubbers such as SBR (styrene-butadiene rubber), NBR (nitrile-butadiene rubber), IR (isoprene rubber), NR (nitrile rubber), CR (chloroprene rubber), IIR (isobutylene-isoprene rubber), BR (butadiene rubber), etc.; thermoplastic elastomers including polystyrene compounds such as RB (butadiene resin) and SBS (styrene-butadiene-styrene elastomer), polyolefine compounds such as polyester, polyurethane compounds, PVC (polyvinyl chloride), etc.; and matters obtained by blending them.

The carbon is selected from a group consisting of carbon products obtained from ISAF (intermediate super abrasion furnace); SAF (super abrasion furnace), HAF (high abrasion furnace black), FEF (fast extrusion furnace), SRF (semi-reinforcing furnace) FT (fine thermal), EPC (easy processing channel), MPC (medium processing channel) or products obtained by blending them.

The inorganic filler is selected from a group consisting of calcium carbonate, clay of varied kinds. talc, and products obtained by blending them or silica fillers such as hydrous silicate, anhydrous silicate.

A softener (or oil) usable for the rubber member is selected from a group consisting of vegetable oils of an aromatic, naphthane or paraffin system and mineral oils such as paraffin wax, mineral rubber, etc. In addition to them, factice is also usable.

The vulcanization assistant is selected from a group consisting of metal oxides such as zinc white and magnesia and styaric acid representing fatty acid.

The vulcanization accelerator is selected from a group consisting of aldehyde amine, guanidine, thiazole, thiuram, diocarbamate, xanthogenate, etc. and various combinations of them.

The cross linking agent is selected from a group consisting of peroxides such as dicumyl peroxide, ditertiary-butyl peroxide, benzoyl peroxide, etc. The group also includes sulfur chloride, organic sulfur containing compounds, metal oxides, quinone dioxine, organopolyamine, modified phenol resin, etc.

The plasticizer is selected from a group consisting of phthalates such as DBP (dibutyl phthalate), DOP (dioctyl phthalate), etc.; adipates such as DOA (dioctyl adipate), etc.; sebacates such as (dioctyl sebacate), etc.; phosphates such as TCP (tricresyl phosphate), etc.; and, in addition to them, polyether, polyester, etc. Further, an organic reinforcer usable for the rubber member is selected from a group consisting of high styrene resin, phenol resin, modified melamine resin, etc. A tackifier which is usable for the rubber member may be selected from a group consisting of cumarone-indene resin, phenol-indene resin, rosin derivatives, etc. An antioxidant which is usable for the rubber member may be selected from a group consisting of aldehyde, ketone, amine and their derivatives or from among wax compounds and their various combinations.

A masticating agent for the rubber member is selected from a group consisting of xylyl-mercaptan, 2-bensamido-thiophenol, zincate, etc.

Furthermore, in accordance with this invention, a solid cylindrical base body is used as a core member. Compared with the conventional platen roller, the platen roller according to this invention is capable of suppressing to a greater degree the noises and vibrations which are generated in printing, by virtue of the use of the solid cylindrical base body. As mentioned in the foregoing, the core member of the conventional platen roller is a metal cylinder generally made of stainless steel, aluminum or soft steel. In the case of a printer of the print hammer type, however, such cylinder generates a great degree of noises in printing. In the case of the embodiment of this invention, the outer circumferential surface of the solid cylindrical base body which has rotating shafts at both ends thereof is encompassed with the elastic rubber layer. The diameter of the solid cylindrical base body is arranged to be within a range of ratio from 45 to 75% to the outside diameter of the finished platen roller. This arrangement of the invention effectively prevents the generation of the printing noise, because: The vibrations generated by the pounding impact on the surface of the platen roller is first absorbed by the elastic rubber layer with which the outside of the solid cylindrical base body is covered. The vibrations are further absorbed also by the solid cylindrical base body which is made of a rigid vibration suppressing material. The embodiment is, therefore, capable of sufficiently suppressing the noises and vibrations for adequate printing.

Such an excellent noise and vibration preventing effect of the embodiment has been hardly attainable by the conventional platen roller having a hollow cylindrical base body the diameter of which is arranged to be in the ratio between 50 and 70% to the outside diameter of the finished platen roller. However, if the above stated ratio of the base body diameter to the finished roller is less than 45%, the above stated excellent noise and vibration preventing effect is not attainable. Further, if the ratio exceeds 75%, the platen roller becomes too heavy for practical applications as it imposes an excessive load on a motor arranged to drive the roller.

In the preferred mode of application of this invention, the solid cylindrical base body having the rotating shafts at two ends thereof comprises the rotating shaft parts which are made of a material excelling in corrosion resisting and sliding properties and a solid cylindrical base body part which is made of a material excelling in vibration suppressing effect.

The solid cylindrical base body thus has the rotating shaft parts and the base body part arranged to be discrete members. Compared with the use of a base body which is made in one body, the use of the base body of the above stated discrete structural arrangement is advantageous in terms of reduction in cost, because: The platen roller is to be rotatively used as printing paper conveying means for the printer of a typewriter or the like. Therefore, the durability of the platen roller greatly depends on the material of the rotating shaft. If the solid cylindrical base body has its rotating shafts and its base body part formed in one body, its material must be selected in consideration of a broader range of physical properties especially including the sliding and corrosion resisting properties. This requirement severely limits the range of selectable materials and tends to increase the cost of the roller. Whereas, the solid cylindrical base body according to this invention is arranged to permit the rotating shafts to be made of a material which can be selected simply considering the corrosion resisting and slidable properties and to permit the base body to be made of a material which is selectable simply considering the vibration suppressing effect. The arrangement of the embodiment thus not only broadens the range of selectable materials but also is advantageous in terms of reduction in cost.

Figure 4:
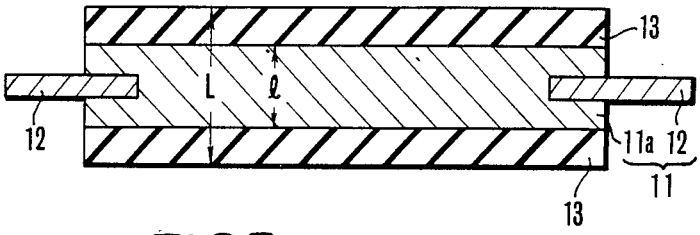
FIGS. 4 to 7 are sectional views showing various examples of platen rollers embodying this invention.

FIG. 4 is a sectional view showing by way of example the platen roller of this invention using the solid cylindrical base body. As shown, the platen roller is basically formed with the elastic rubber layer 13 arranged round the circumference of the solid cylindrical base body 11 which has rotating shafts 12. The elastic rubber layer 13 may be made from a hard rubber, resin or fabric material. Meanwhile, as mentioned in the foregoing, the solid cylindrical base body 11 must be arranged to have its outside diameter l within the range of ratio (l/L) from 45 to 75% to the outside diameter L of the finished platen roller which consists of the elastic rubber layer 13 as well as the base body 11. This range of ratio is preferably from 55 to 75% and more preferably from 60 to 75%.

The solid cylindrical base body 11 is made of a material selected from a group of such materials that have a high degree of attenuating power to have vibration energy consumed by the internal friction of composition, including, for example, metals of relatively large specific gravity such as iron, lead, zinc, etc.; or alloys containing at least one of them such as gray iron, a zinc-aluminum alloy, etc. The solid cylindrical base body 11 may have the rotating shafts formed in one body therewith. However, with respect to reduction in cost, the solid cylindrical base body 11 is preferably arranged in a composite manner to have the base body part 11*a* thereof arranged, as shown, separately from the rotating shaft parts 12 with the base body part 11*a* made of a material which is different from that of the rotating shaft parts 12.

In the case of such a composite structural arrangement, the rotating shaft parts 12 is made of, for example, a stainless steel material or the like that excels in slidable and corrosion resisting properties while the solid cylindrical base body part 11*a* is preferably made of an iron material or the like that excels in vibration suppressing property and is advantageous in terms of reduction in cost. The rotating shaft parts 12 are fitted into the solid cylindrical base body part 11*a* by pressure fitting, shrink fitting or the like. As mentioned above, the adoption of the composite (or discrete) structural arrangement allows a broader material selecting range as well as reduction in cost.

Figure 5:
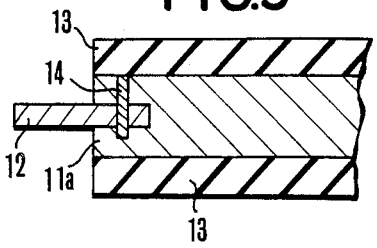

Another example of the platen rollers according to this invention is arranged as follows: FIG. 5 shows it. In this case, the rotating shaft parts 12 are more firmly secured to the base body part 11*a* by means of pins 14. Each of the pins 14 is inserted into the solid cylindrical base body 11 from outside thereof to perpendicularly pierce through each of the rotating shaft parts 12. This arrangement effectively prevents the shaft parts 12 from coming off the solid cylindrical base body part 11*a*.

Figure 6:
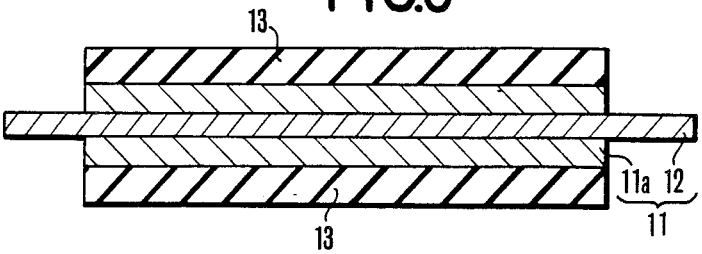

A further example of the platen rollers according to this invention is arranged as shown in FIG. 6. In the case of FIG. 6, the solid cylindrical base body 11 is formed with a single rotating shaft 12 allowed to pierce through the base body parts 11*a*.

Figure 7:
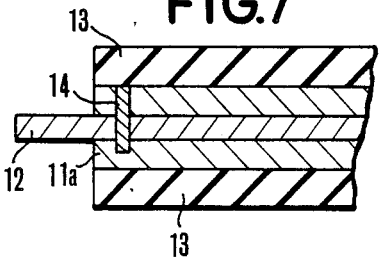

A still further example of the platen rollers according to the invention is arranged as shown in FIG. 7. In the case of FIG. 7, with the single rotating shaft 12 allowed to pierce through the solid cylindrical base body part 11*a*, the shaft 12 is secured to the base body 11 by means of pins 14.

The further details of this invention will be comprehended from the following description of embodiments:

EMBODIMENT 1

A rubber material was obtained by subjecting a rubber composite blended as shown in Table 1 to a press curing process which was carried out at 140° C. for a period of 70 min. The hardness value of the rubber material was 93, JIS A, (20° C., JIS K6301-5.2) and the rebound resilience value thereof was 6% (20° C., JIS K6301-11).

TABLE 1

| Materials blended | Parts by weight |
|---|---|
| SBR 1502 | 100 |
| ISAF carbon | 20 |
| precipitated calcium carbonate | 130 |
| aromatic oil | 10 |
| zinc white | 3 |
| stearic acid | 2 |
| accelerator, CZ (N-Cyclohexyl-2-benzothiazyl-sulfenamide) | 1 |
| accelerator, TS (Tetra methylthiuram-monosulfide) | 0.2 |
| sulfur | 35 |

The above stated rubber material is applied to the outer surface of a stainless steel core member of a shape as shown in FIG. 1, (22 mm in outside diameter, 16 mm in inside diameter and 400 mm in length) by lamination to a thickness of 7 mm. A platen roller embodying this invention is thus obtained.

Figure 3:
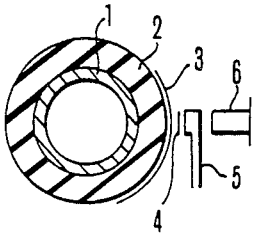
FIG. 3 shows a printing arrangement.

A printing test was conducted by mounting this platen roller on a printer which was provided with a monochromatically molded daisy wheel as shown in FIG. 3. The test results showed that the platen roller enabled a capital letter H of alphabet to be adequately printed with a very small amount of impact energy such as 17 mJ or thereabout. A total of hundred thousand letters were continuously printed in the test. However, no tangible changes were observed in the printing performance.

EMBODIMENT 2

A rubber material was obtained by subjecting a rubber composite blended as shown in Table 2 to a press curing process which was carried out at 140° C. for a period of 60 min. The hardness value of the rubber material thus obtained was 97, JIS A, (20° C., JIS K6301-5.2) and the rebound resilience value thereof was 4.5% (20° C., JIS K6301-11).

TABLE 2

| Materials blended | Parts by weight |
|---|---|
| SBR 1502 | 100 |
| ISAF carbon | 30 |
| precipitated calcium carbonate | 170 |
| aromatic oil | 15 |
| zinc white | 3 |
| stearic acid | 2 |
| accelerator, CZ | 1 |
| accelerator, TS | 0.2 |
| sulfur | 40 |

Using the above stated rubber material, a platen roller was prepared and a test was carried out in the same manner as in the case of Example 1. The test results showed that the platen roller enabled printing to be adequately performed with about the same small amount of impact energy as in the case of Embodiment 1. Further, a total of hundred thousand letters were continuously printed in the test. However, no tangible changes were observed in the printing performance.

COMPARATIVE EXAMPLE 1

A rubber material was obtained by subjecting a rubber composite blended as shown in Table 3 below to a press curing process which was carried out at 140° C. for a period of 70 min. The rubber material thus obtained has a hardness value of 93, JIS A, (20° C., JIS K6301-5.2) and a rebound resilience value of 10% (20° C., JIS K6301-11).

TABLE 3

| Materials blended | Parts by weight |
|---|---|
| SBR 1502 | 100 |
| ISAF carbon | 20 |
| precipitated calcium carbonate | 80 |
| aromatic oil | 7 |
| zinc white | 3 |
| stearic acid | 2 |
| accelerator, CZ | 1 |
| accelerator, TS | 0.2 |
| sulfur | 30 |

Using the rubber material thus obtained, a platen roller was prepared and a printing test was conducted in the same manner as in the case of Embodiment 1. According to the test results, a large amount of impact energy was necessary for adequately printing the capital letter H of alphabet. With letters continuously printed in the test, the printed letters became defective when about ten thousands of letters were printed.

EMBODIMENT 3

A rubber material was obtained by subjecting a rubber composite blended as shown in Table 4 below to a press curing process which was carried out at 150° C. for a period of 90 min. The rubber material thus obtained had a hardness value of 92, JIS A, (20° C., JIS K6301-5.2) and a rebound resilience value of 4% (20° C., JIS K6301-11).

TABLE 4

| Materials blended | Parts by weight |
|---|---|
| SBR 1502 | 100 |
| ISAF | 40 |
| precipitated calcium carbonate | 200 |
| aromatic oil | 55 |
| zinc white, No. 1 | 3 |
| stearic acid | 2 |
| vulcanization accelerator, CZ | 1 |
| vulcanization accelerator, TS | 0.2 |
| sulfur | 20 |

A platen roller according to this invention was prepared by laminating the above stated rubber material to a thickness of 7 mm round the circumferential surface of a solid cylindrical base body which was in a shape as shown in FIG. 4, measuring 22 mm in outside diameter and 400 mm in length.

A printing test was conducted by mounting this platen roller on a typewriter having a monochromatically molded daisy wheel as shown in FIG. 3. The test results showed that the platen roller enabled a capital letter H of alphabet to be adequately printed with a very small amount of impact energy of about 17 mJ. A total of hundred thousand letters were continuously printed in the test. However, no tangible changes were observed in the printing performance. Further, in conducting the printing test, sounds generated by printing were measured within a sound-proof room, one meter away from the typewriter, by means of a simplified sound meter, Model 2215, manufactured by Brüel & Kjaer. The measured value of the printing sound thus obtained was 51.5 dB.

EMBODIMENT 4

A rubber material was obtained by subjecting a rubber composite blended as shown in Table 5 below to a press curing process which was carried out at 150° C. for a period of 90 min. The rubber material thus obtained had a hardness value of 95, JIS A, (25° C., JIS K6301-5.2) and a rebound resilience value of 7% (25° C., JIS K6301-11).

TABLE 5

| Materials blended | Parts by weight |
|---|---|
| SBR 1502 | 100 |
| ISAF | 40 |
| precipitated calcium carbonate | 230 |
| aromatic oil | 20 |
| zinc white, No. 1 | 3 |
| stearic acid | 2 |
| vulcanization accelerator, CZ | 1 |
| vulcanization accelerator, TS | 0.2 |
| sulfur | 20 |

Using the rubber material thus obtained, a platen roller was prepared and a printing test was conducted in the same manner as in the case of Embodiment 3. Printing was adequately performed with about the same small amount of impact energy as in the case of Embodiment 3. A total of hundred thousand letters were continuously printed in the test. However, no tangible changes were observed in the printing performance. In this instance, printing sounds were measured in the same manner as in Embodiment 3. The measured printing sounds were also about the same as those of Embodiment 3.

EMBODIMENT 5

A rubber material was prepared by subjecting a rubber composite blended as shown in Table 6 below to a press curing process which was carried out at 150° C. for a period of 60 min. The rubber material thus obtained had a hardness value of 95, JIS4 A, (20° C., JIS K6301-5.2) and a rebound resilience value of 6% (20° C., JIS K6301-11).

TABLE 6

| Materials blended | Parts by weight |
|---|---|
| SBR 1502 | 100 |
| HAF carbon | 60 |
| precipitated calcium carbonate | 150 |
| aromatic oil | 20 |
| zinc white, No. 1 | 3 |
| stearic acid | 2 |
| vulcanization accelerator, CZ | 1 |
| vulcanization accelerator, TS | 0.2 |
| sulfur | 20 |

Using the rubber material thus obtained, a platen roller was prepared and subjected to a printing test in the same manner as in the case of Embodiment 3. The platen roller enabled printing to be adequately performed with about the same small amount of impact energy as in Embodiment 3. Further, the result of test printing of hundred thousand letters showed no tangible changes. Printing sounds were also measured in the same manner as in Embodiment 3. The measured printing sounds were also small and were about the same as in Embodiment 3.

COMPARATIVE EXAMPLE 2

A rubber material was prepared by subjecting a rubber composite blended as shown in Table 7 to a press curing process which was carried out at 150° C. for a period of 90 min. The rubber material thus obtained had a hardness value of 92, JIS A, (25° C., JIS K6301-5.2) and a rebound resilience value of 10% (25° C., JIS K6301-11).

TABLE 7

| Materials blended | Parts by weight |
|---|---|
| SBR 1502 | 100 |
| ISAF carbon | 30 |
| precipitated calcium carbonate | 150 |
| aromatic oil | 20 |
| vulcanization accelerator, DM (Dibenzothiazyldisulfide) | 1 |
| vulcanization accelerator, D (Diphenylguanidine) | 0.2 |
| sulfur | 20 |
| zinc white, No. 1 | 3 |
| stearic acid | 2 |

Using the above stated rubber material, a platen roller was prepared and subjected to a printing test in the same manner as in Embodiment 3. A large amount of impact energy of about 25 mJ was necessary for adequately printing the capital letter H of alphabet. Further, with letters continuously printed in the test, the printed letters became defective when about ten thousands of letters were printed. The result of a printing sound measuring test which was conducted in the same manner as in Embodiment 3 showed a large value of 56.5 dB.

EMBODIMENT 6

A solid cylindrical base body 11 of the shape shown in FIG. 4 is prepared by discretely forming the rotating shaft parts with stainless steel and the base body part with iron. A platen roller which was as shown in FIG. 4 was obtained by laminating on the base body 11 a vulcanized product which was blended as shown in Table 4. Then, six variations of the platen roller were prepared by varying the ratio (l/L) of the diameter l of the solid cylindrical base body to the outside diameter L (=22 mm) of the finished roller within the range of ratio from 45 to 75%.

Figure 8:
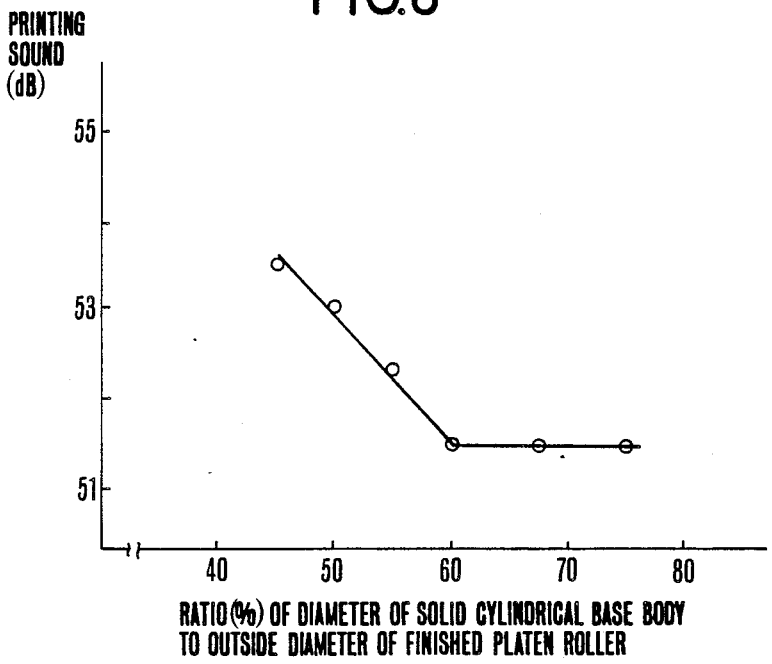
FIG. 8 is a graph showing the printing sound level of the invented platen roller in relation to the ratio of the diameter of a solid cylindrical base bodY to the outside diameter of a finished platen roller product.

Each of the platen rollers thus obtained was subjected to a printing sound measuring test which was conducted in the same manner as in Embodiment 4. FIG. 8 shows the measured values (in dB) thus obtained in relation to the above stated ratios (l/L). As is apparent from FIG. 8, the printing sounds of the platen rollers prepared within the range of ratio (l/L) from 45 to 75% were small. The rollers having the ratio above 60% had an especially salient printing sound suppressing effect.

Further, platen rollers which were prepared by using rubber composites of Table 5 and Table 6 in place of the rubber composite of Table 4 gave exactly the same test results.

COMPARATIVE EXAMPLE 3

A platen roller was prepared in the same manner as in Embodiment 6 with the exception that the above stated ratio (l/L) was changed to 40%. The measured printing sound of this platen roller was 54.5 dB, which was larger than the test results obtained from the embodiments of this invention. Variations of this platen roller which were prepared by using the rubber composites of Tables 5 and 6 instead of that of Table 4 also gave exactly the same test result.

COMPARATIVE EXAMPLE 4

A platen roller was prepared in the same manner as in Embodiment 6 with the exception that the above stated ratio (l/L) was changed to 80%. The measured printing sound of that platen roller was 52 dB which was relatively small. However, the roller was too heavy for practical applications because of an increased load on a motor used for driving the roller.

What is claimed is:

1. A platen roller for a typewriter, comprising:

a solid cylindrical base body defining a longitudinal axis having first and second ends, said base body providing at least one shaft such that a shaft end protrudes from each of said first and second ends; and an elastic layer made of a rubber material and arranged around the circumferential surface of said solid cylindrical base body, wherein said rubber material contains 15 parts or more by weight of a vulcanizing agent against 100 part by weight of rubber material polymer and an amount of carbon black contained in relation to total inorganic filler included in said rubber material in a range of 28.5% or less by weight, further said rubber material containing 3.3% to 13.1% by weight of softener and some thiuram material as a vulcanization accelerator;

the diameter of said base body being arranged to be in the ratio of 45 to 75% to the outside diameter of the finished platen roller including said base body and said layer, said elastic layer having a hardness value of 95±3, JIS type A, at 20° to 25° C., on the basis of JIS K6301-5.2 and a rebound resilience value of 4 to 7%, at 20° to 30° C., on the basis of JIS K6301-11.

2. A platen roller according to claim 1, wherein the ratio of the diameter of said solid cylindrical base body to the outside diameter of the finished platen roller including said solid cylindrical base body and said elastic layer is within a range from 55 to 75%.

3. A platen roller according to claim 2, wherein the ratio of the diameter of said solid cylindrical base body to the outside diameter of the finished platen roller including said solid cylindrical base body and said elastic layer is within a range from 60 to 75%.

4. A platen roller according to claim 1, wherein said solid cylindrical base body is made of metal.

5. A platen roller according to claim 4, wherein said metal is a material selected from the group consisting of iron, lead and zinc or an alloy containing at least one of said metals.

6. A platen roller according to claim 1, wherein said rotating shafts are inserted into and secured to both ends of said solid cylindrical base body without piercing through said base body.

7. A platen roller according to claim 1, wherein said solid cylindrical base body is composed of rotating shaft parts made of stainless steel.

8. A platen roller for typewriter according to claim 1, wherein the rebound resilience value is 4 to 6% at 20° to 30° C.

* * * * *

UNITED STATES PATENT AND TRADEMARK OFFICE

CERTIFICATE OF CORRECTION

PATENT NO. : 4,981,381 Page 1 of 2

DATED : January 1, 1991

INVENTOR(S) : Jun Murata

It is certified that error appears in the above-identified patent and that said Letters Patent is hereby corrected as shown below:

ON TITLE PAGE:

[56] References Cited:

FOREIGN PATENT DOCUMENTS:
"2809960 12/1986 Japan .... 400/661.1"
should read
--280960 12/1986 Japan .... 400/661.1--.

Attorney, Agent, or Firm:

"Fitzpatrick Cella, Harper & Scinto" should read
--Fitzpatrick, Cella, Harper & Scinto--.

[57] ABSTRACT:

"30°" should read --30°C--.

COLUMN 3:

Line 2, "base bodY" should read --base body--.

Line 66, "kinds." should read --kinds,--.

UNITED STATES PATENT AND TRADEMARK OFFICE

CERTIFICATE OF CORRECTION

PATENT NO. : 4,981,381 Page 2 of 2

DATED : January 1, 1991

INVENTOR(S) : Jun Murata

It is certified that error appears in the above-identified patent and that said Letters Patent is hereby corrected as shown below:

COLUMN 10:

Line 64, "100 part" should read --100 parts--.

Signed and Sealed this

Twenty-first Day of July, 1992

*Attest:*

DOUGLAS B. COMER

*Attesting Officer*

*Acting Commissioner of Patents and Trademarks*